US007311041B2

(12) United States Patent
Niimi

(10) Patent No.: US 7,311,041 B2
(45) Date of Patent: Dec. 25, 2007

(54) PRINTING DEVICE, PRINTING SYSTEM AND PRINTING METHOD

(75) Inventor: Akiko Niimi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 141 days.

(21) Appl. No.: 10/797,186

(22) Filed: Mar. 11, 2004

(65) Prior Publication Data

US 2004/0187715 A1 Sep. 30, 2004

(30) Foreign Application Priority Data

Mar. 27, 2003 (JP) ..... 2003-089011

(51) Int. Cl.
*B41F 15/00* (2006.01)
*B41L 13/00* (2006.01)

(52) U.S. Cl. ..... 101/114; 101/126; 101/129

(58) Field of Classification Search ..... 101/114, 101/129, 126
See application file for complete search history.

(56) References Cited

U.S. PATENT DOCUMENTS 3,244,093 A * 4/1966 Vasilantone ..... 101/126
4,938,130 A * 7/1990 Thorpe ..... 101/126
5,553,536 A * 9/1996 Van Os ..... 101/44
5,626,074 A * 5/1997 Zelko ..... 101/115
5,857,410 A * 1/1999 Watanabe et al. ..... 101/116
6,016,746 A 1/2000 Lake et al.
6,019,046 A * 2/2000 Rodi ..... 101/479
6,038,970 A * 3/2000 Benedetto et al. ..... 101/127.1
6,038,977 A * 3/2000 Haney et al. ..... 101/490
6,070,525 A * 6/2000 Watanabe et al. ..... 101/129
6,101,937 A * 8/2000 Murakami ..... 101/123
6,192,795 B1 2/2001 D'Alessandro
6,375,293 B1 * 4/2002 Endo ..... 347/2
6,397,740 B1 * 6/2002 Dubuit ..... 101/41
6,471,430 B1 * 10/2002 Gaus et al. ..... 400/635
6,505,553 B2 1/2003 Ishida et al.
6,568,321 B2 * 5/2003 Sakamoto ..... 101/126
6,631,985 B2 * 10/2003 Koizumi et al. ..... 347/101

(Continued)

FOREIGN PATENT DOCUMENTS

JP A 10-31440 2/1998

(Continued)

*Primary Examiner*—Daniel J. Colilla
*Assistant Examiner*—Marissa Ferguson-Samreth
(74) *Attorney, Agent, or Firm*—Oliff & Berridge, PLC.

(57) ABSTRACT

A printing device contains a printing medium supporting member having a supporting face for supporting a printing medium; a screen plate fitting detachably onto said supporting face in a state where the printing medium is sandwiched between said screen plate and said supporting face of said printing medium supporting member; and an ink emission section for emitting ink onto the printing medium on said supporting face. A printing system has the printing device described above, and ink color determining means for setting the color of the ink used in printing by means of said screen plate to a lighter color than the ink used in printing by means of said ink emission section. A printing method contains the step of screen printing for printing onto a printing medium by means of a screen plate, and the step of ink emitting for emitting ink of a darker color than the ink used in said screen printing step, onto the screen printed region, from an ink emission section.

15 Claims, 5 Drawing Sheets

U.S. PATENT DOCUMENTS

| | | | | |
|---|---|---|---|---|
| 6,711,998 | B2 * | 3/2004 | Hashimoto | 101/129 |
| 6,765,690 | B1 * | 7/2004 | Matsumoto et al. | 358/1.2 |
| 6,821,038 | B2 * | 11/2004 | Izawa | 400/621.1 |
| 6,871,589 | B2 * | 3/2005 | Hashimoto | 101/129 |
| 7,007,601 | B2 * | 3/2006 | Winter et al. | 101/35 |
| 2001/0032556 | A1 | 10/2001 | Ishida et al. | |
| 2002/0122208 | A1 * | 9/2002 | Siegeritz | 358/2.1 |
| 2003/0041752 | A1 * | 3/2003 | Witte | 101/128.21 |

FOREIGN PATENT DOCUMENTS

| | | |
|---|---|---|
| JP | B2 3218274 | 8/2001 |
| JP | A 2001-301120 | 10/2001 |
| JP | A 2002-38382 | 2/2002 |
| JP | A 2002-79661 | 3/2002 |
| JP | A 2002-154246 | 5/2002 |

* cited by examiner

PRINTING DEVICE, PRINTING SYSTEM AND PRINTING METHOD

BACKGROUND OF THE INVENTION

1. Field of the Invention

The present invention relates to a printing device, printing system and printing method for printing desired images onto a printing medium, such as fabric, for example, through combined use of screen printing and ink-jet printing.

2. Description of the Related Art

One conventional method for printing images on fabric, such as a T-shirt, for example, is screen printing wherein ink is coated onto a fabric by means of a screen plate on which an image is formed. Since screen printing uses a screen plate, productivity is high, but when printing color images, or the like, a plurality of screen plates must be fabricated. A further method is ink-jet printing wherein ink is emitted directly onto the fabric by means of an ink emitting head. Ink-jet printing of this kind enables highly complex multi-colored printing to be carried out readily, but it takes a long time to printing large surface areas, such as background images, or the like.

Therefore, in recent years, it has been proposed that screen printing and ink-jet printing be used in combination. For example, Japanese Patent No. 3,218,274 discloses a textile printing device which combines a plate-based printing device comprising a screen plate, and a plate-less printing device based on an ink-jet method. After a color design and positioning marks have been printed onto the fabric by means of the plate-based printing section, the fabric is then conveyed to the plate-less printing section, where full color printing is carried out by means of ink-jet printing. In the plate-based printing section, a plurality of screen plates are arranged in parallel fashion, in line with a conveyor belt which transports the fabric. In the plate-less printing section, on the other hand, the positioning marks on the fabric are detected by reading means, and the screen printing image and the ink-jet printing image are made to coincide in position on the basis of these marks.

Moreover, Japanese Patent Application Laid-Open No. 2002-154246 discloses a method wherein, when printing onto a fabric, such as a T-shirt, by means of ink-jet printing, a pre-treatment liquid is coated only onto the region of the fabric that is to be printed, by means of a screen printing method, or the like. The fabric is set on the screen frame and the pre-treatment liquid is coated onto it, whereupon the fabric is set in a printing tray, this tray is installed in an ink-jet printing device, and ink-jet printing is performed. When setting the pre-treated fabric in the printing tray, the operator performs the positional alignment in such a manner that the pre-treated portion and the upper plate of the tray coincide in position.

However, in the device according to Japanese Patent No. 3,218,274, in order to align the positions of the screen printing image and the ink-jet printing image, positioning marks are printed onto the fabric in the plate-based printing section, and these positioning marks on the fabric are detected by reading means in the plate-less printing section. Therefore, special positioning marks and reading means, and the like, are required, and a problem arises in that the configuration of the textile printing device, and the functions thereof, become complicated. Moreover, by arranging a plurality of screen plates in parallel, in line with the direction of travel of a conveyor belt, a problem is created in that overall textile printing device becomes large in size.

Furthermore, in the device according to Japanese Patent Application Laid-Open No. 2002-154246, when setting the pre-treated fabric in the printing tray, the operator must align the positions of the pre-treated section and the upper plate of the tray, in order that they coincide. Therefore, and particularly in cases where an image has been printed in the pre-treatment stage, the operator must pay very careful attention to aligning the positions in order that this first image coincides exactly with the ink-jet printing image to be printed subsequently. Therefore, a problem arises in that the workability deteriorates, and device operability also deteriorates.

SUMMARY OF THE INVENTION

Therefore, it is an object of the present invention to provide a printing device, printing system and printing method whereby an image printed by screen printing and an image printed by ink-jet printing can be made to coincide in position, readily and accurately.

According to a first aspect of the present invention, provided is a printing device which comprises: a printing medium supporting member having a supporting face for supporting a printing medium; a screen plate fitting detachably onto the supporting face in a state where the printing medium is sandwiched between the screen plate and the supporting face of the printing medium supporting member; and an ink emission section for emitting ink onto the printing medium on the supporting face.

According to this configuration, by providing a screen plate that fits detachably with the supporting face of a printing medium support member on which the print medium is supported, it is possible to reduce the size of the printing device, as compared with a device in which a plurality of screen plates are provided in parallel fashion in the direction of travel of a conveyor belt. Moreover, if the image printed on the printing medium by means of a screen plate is the same size as the image printed on the printing medium by emission of ink from an ink emission section, then since the screen plate fits detachably to the supporting face of the printing medium supporting member, the images printed onto the printing medium can be mutually superimposed accurately, simply by means of aligning the positions of the image formed by the screen plate and the image formed by the ink emission section, by taking the supporting face as a reference. Therefore, special positional alignment tasks are not required, it being sufficient simply to fit the screen plate onto the supporting face of the printing medium supporting member.

The printing device according to the present invention may further comprise ink color determining means for setting the color of the ink used in printing by means of the screen plate to a lighter color than the ink used in printing by means of the ink emission section.

According to this configuration, by comprising ink color determining means, the ink used in printing by means of the screen plate can be set to a color that is lighter than the ink used in printing by means of the ink emission section. Consequently, when an image has been printed by means of the ink emission section onto an image printed onto the printing medium by means of the screen plate, the inks in the final image on the printing medium will show better coloration.

In the printing device according to the present invention, the ink color determining means may set the color of the ink used in printing by means of the screen plate to white.

According to this configuration, by setting the ink used in the printing by means of the screen plate to white ink, when an image has been printed by means of the ink emission section onto an image printed on the printing medium by means of the screen plate, then the inks in the final image on the printing medium will display even better coloration.

In the printing device according to the present invention, a plurality of the screen plates of different types may be prepared, each having a different size in accordance with the thickness of the printing medium, in such a manner that the screen plate fits onto the supporting face in a state with substantially no gaps with respect to the printing medium.

According to this configuration, by preparing a plurality of different types of screen plates each having different sizes according to the thickness of the printing medium supported on the printing medium supporting member, there will be substantially no gaps between the screen plate and the printing medium, and hence the printing medium can be prevented from rising up between the supporting face and the screen plate, or forming wrinkles.

In the printing device according to the present invention, the screen plate or the printing medium supporting member may comprise an adjusting mechanism whereby the screen plate can be fitted onto the supporting face in a state with substantially no gaps with respect to the printing medium.

According to this configuration, by providing an adjustment mechanism in the screen plate or printing medium supporting member, it becomes unnecessary to prepare a plurality of different types of screen plates.

In the printing device according to a sixth aspect of the present invention, the screen plate is of substantially the same shape as the supporting face.

According to this configuration, since the screen plate and the supporting face are of the same shape, then simply by aligning the size and position of the image formed by means of the screen plate and the image formed by means of the ink emission section, by taking the supporting face as a reference, the images formed by the respective printing methods on the printing medium are superimposed accurately without positional deviation therebetween.

In the printing device according to the present invention, the printing medium is preferably a fabric.

According to this configuration, even if a dark-colored fabric is used as the printing medium, since printing by means of the ink emission section is carried out on top of an image printed by means of the screen plate, it is possible to print an image of good quality onto the fabric.

According to a second aspect of the present invention, provided is a printing system which comprises: the printing device according to the first aspect of the present invention; and ink color determining means for setting the color of the ink used in printing by means of the screen plate to a lighter color than the ink used in printing by means of the ink emission section.

According to this configuration, by providing ink color determining means, it is possible to set the ink used in printing by means of the screen plate to a color that is lighter than the ink used in printing by means of the ink emission section. Therefore, when an image has been printed by means of the ink emission section onto an image printed on the printing medium by means of the screen plate, the inks in the final image on the printing medium will display good coloration.

In the printing system according to the present invention, the ink color determining means may set the color of the ink used in printing by means of the screen plate to white.

According to this configuration, since the ink used in the printing by means of the screen plate is set to white ink, then when an image has been printed by means of the ink emission section onto an image printed on the printing medium by means of the screen plate, the inks in the final image on the printing medium will display even better coloration.

According to a third aspect of the present invention, provided is a printing method which comprises the steps of: screen printing for printing onto a printing medium by means of a screen plate; and ink emitting for emitting ink of a darker color than the ink used in the screen printing step, onto the screen printed region, from an ink emission section.

According to this configuration, when an image has been printed by means of the ink emission section in the ink emitting step, onto an image printed onto a printing medium in a screen printing step, the colors of the image in the printing carried out by the ink emission step will not be obscured, and it will be possible to obtain a clear image. In other words, if ink is printed directly onto a dark-colored fabric, or the like, by the ink emission section, then the ink forming the image will be obscured by the dark-colored fabric, but since the image printed by the screen printing step is not obscured by the dark-colored fabric, then when an image is printed on top of that image in the ink emission step, obscuring of the colors of that image will be prevented. Therefore, the inks in the final image on the printing medium will display good coloration.

In the printing method according to the present invention, the ink used in the screen printing step is preferably white in color.

According to this configuration, since the ink used in the screen printing step is set to be white ink, then when an image has been printed by means of the ink emission section in the ink emission step, onto an image printed on the printing medium in the screen printing step, the inks in the final image on the printing medium will display even better coloration.

DESCRIPTION OF THE PREFERRED EMBODIMENTS

Below, a preferred embodiment of the present invention is described with reference to the drawings. The printing device and printing method relating to this embodiment comprise the configuration and processes of an ink-jet printer.

(General Configuration of Printer)

Figure 1:
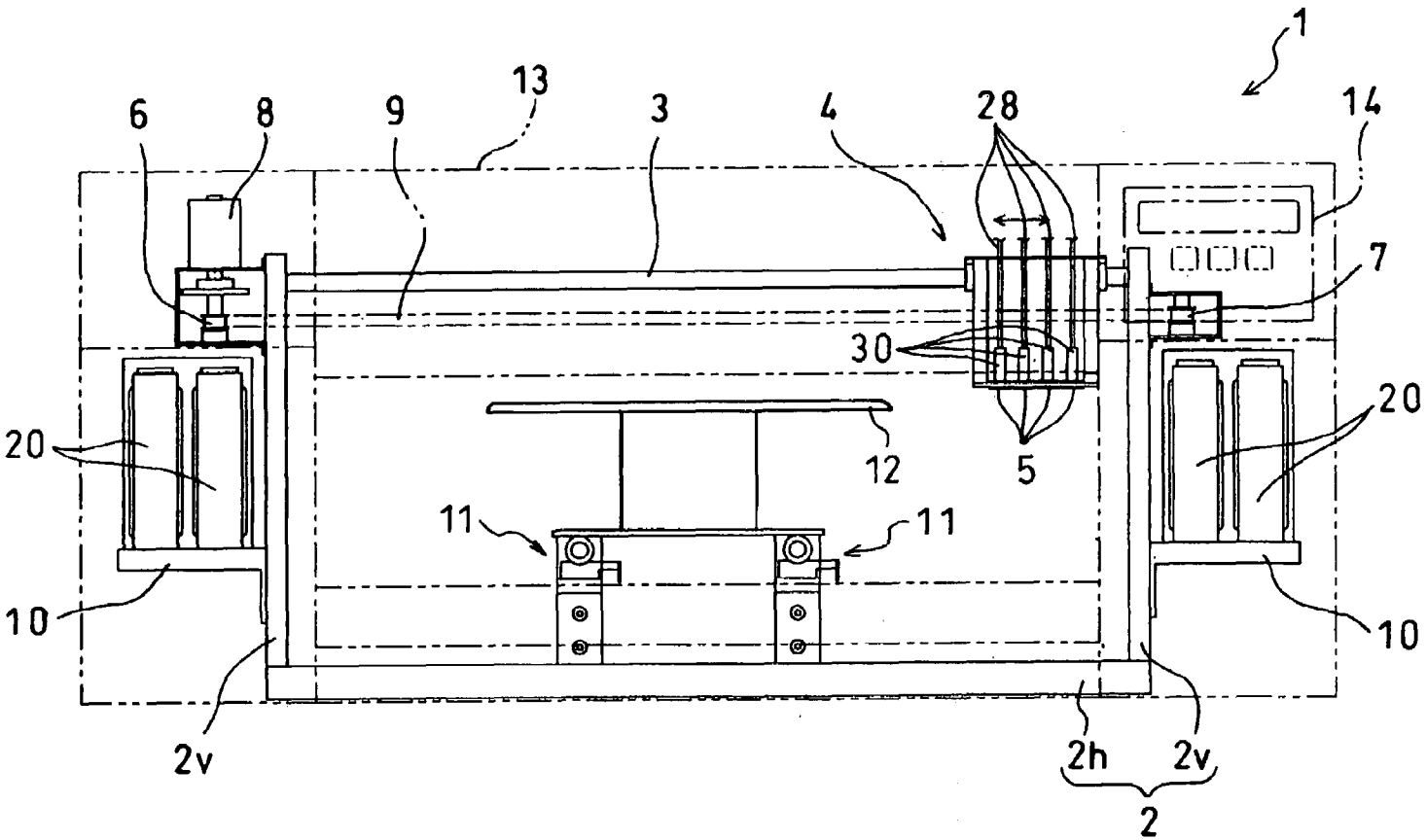
FIG. 1 is a front view showing the general configuration of an ink-jet printer relating to one embodiment of the present invention.

FIG. 1 is a front view showing the general configuration of an ink-jet printer relating to one embodiment of the present invention. As shown in FIG. 1, the ink-jet printer 1 comprises a frame 2. This frame 2 has a horizontal section 2*h* disposed in the lower part of the device, and vertical sections 2*v* which rise up vertically from the respective ends of the horizontal section 2*h*.

A slide rail 3 is suspended horizontally in such a manner that the upper portions of the respective left and right-hand vertical sections 2*v* are mutually connected. A carriage 4 is provided on the slide rail 3, slidably in the longitudinal direction of the rail (main scanning direction). A total of four piezoelectric ink-jet heads 5 are provided on the lower face of the carriage 4, one head being disposed for one of four colors (for example, cyan, magenta, yellow or black) in order to emit ink of that color.

Pulleys 6, 7 are supported respectively on the left and right-hand vertical sections 2*v*, and a motor shaft of a motor 8 supported by the vertical sections 2*v* is coupled to one of the pulleys 6. An endless belt 9 is extended between the pulleys 6, 7, and the carriage 4 is fixed to an appropriate portion of this endless belt 9.

By means of the above configuration, when the pulley 6 is rotated in the forward or backward direction by the drive of the motor 8, the carriage 4 is accordingly driven reciprocatingly in a linear fashion, in the longitudinal direction of the slide rail 3 (main scanning direction), and consequently, the ink-jet heads 5 performs reciprocating movement, back and forth.

A mounting section 10 on which an ink tank 20 can be mounted detachably is formed respectively on both of the left and right-hand vertical sections 2*v*. The two mounting sections 10 are each capable of holding ink tanks for two colors, and ink bags formed inside each ink tank 20 are connected respectively to four subsidiary tanks 30 provided respectively on the top ends of the ink-jet heads 5, by means of flexible tubes 28. The four subsidiary tanks 30 are respectively connected to the ink-jet heads 5, whereby ink can be supplied from the ink tanks 20 to the ink-jet heads 5.

A slide mechanism 11 is disposed on the horizontal section 2*h* of the frame 2, and a flat bed-type platen 12 is supported on this slide mechanism 11. The fabric forming the medium to be printed on can be positioned on this platen 12 in such a manner that the portion to be printed is facing upwards, the fabric being pulled tight in an unwrinkled state thereon. The ink-jet printer 1 according to the present embodiment performs ink-jet printing onto a T-shirt that has been embroidered.

Moreover, a platen conveyance mechanism is provided in order that the platen 12 moves reciprocatingly in a direction perpendicular to the paper in FIG. 1 (a subsidiary scanning direction of the ink-jet printer 1 and the sliding direction of the sliding mechanism 11). This platen conveyance mechanism is not illustrated, but it may be constituted by means of a rack and pinion mechanism, or an endless belt mechanism, or the like.

In the initial state, the platen 12 moves in a forward direction (towards the reader in the case of FIG. 1), the operator sets the fabric on the platen 12, and when a printing start command is issued, the platen 12 is moved in the rearward direction (away from the reader in FIG. 1). By means of the platen 12 being moved intermittently in the forward direction, whilst the ink-jet head 5 is moved reciprocatingly between each movement of the platen, printing is carried out onto the fabric. When printing has been completed, the platen 12 moves back to its initial position on the front side. The operator then removes the fabric from the platen 12.

As shown in FIG. 1, the four ink-jet heads 5 are provided in a parallel fashion in the direction of reciprocating movement of the carriage 4, one head being provided for one of four ink colors (magenta, yellow, cyan or black), and they are connected to their corresponding ink tanks 20 by means of flexible tubes 28 and subsidiary tanks 30.

The ink-jet heads 5 are disposed in such a manner that the lower faces thereof form a small gap with respect to the upper face of the platen 12, and when printing an image onto a fabric, the region to be printed on the fabric set on the platen 12 passes through this gap. By means of this configuration, by moving the ink-jet heads 5 reciprocatingly by means of the carriage 4, whilst emitting ink of respective colors onto the fabric from the emission nozzles, it is possible to form a desired color image onto the fabric.

Moreover, a cover 13 is provided on the ink-jet printer 1, in such a manner that it can cover and protect the ink-jet heads 5, the slide mechanism 11, and the like. In FIG. 1, the cover 13 is shown in a transparent fashion by means of a dotted line, in order that the detailed configuration inside the cover 13 can be depicted. An operating panel 14 provided with a liquid crystal display section and operating keys is disposed on the front face of the cover 13, in the upper right position in FIG. 1.

(Description of Printing Process)

Figure 2:
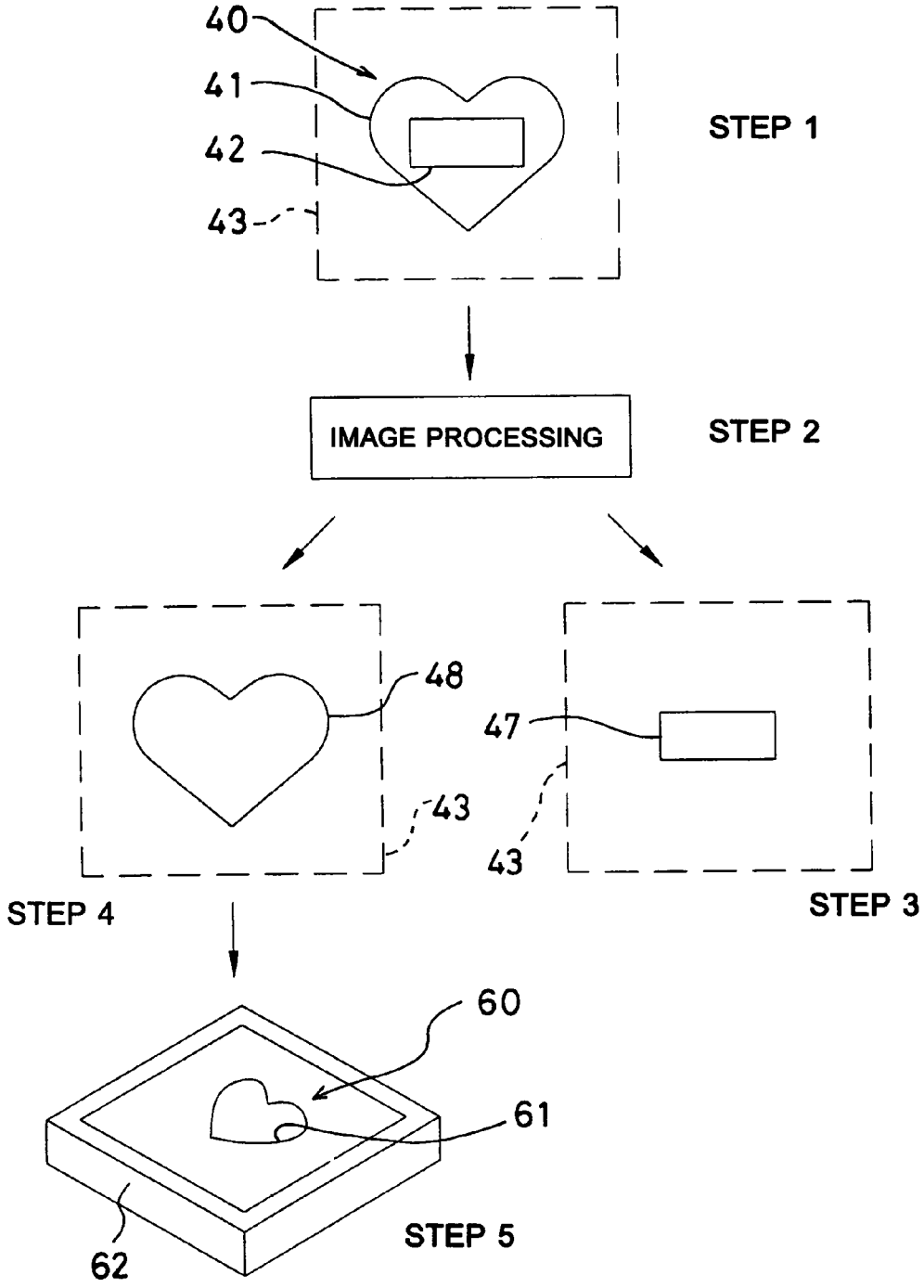
FIG. 2 is a process diagram giving a schematic illustration of the printing process according to the present embodiment, from the step of obtaining original image data to the step of manufacturing a screen.

Next, a printing process using the ink-jet printer 1 described above will be explained. FIG. 2 is a process diagram giving a schematic illustration of the printing processes according to the present embodiment, from the step of obtaining original image data to the step of fabricating a screen plate, and FIG. 3 is a process diagram giving a schematic illustration of the printing processing according to the present embodiment, from the step of setting the fabric on the platen to the end of printing.

To give a general overview of the printing processes of the present embodiment, as illustrated in FIG. 2, firstly, the desired original image data 40 that is to be printed is obtained at step 1, the image is processed in step 2, and image data for ink-jet printing 47 is obtained in step 3 and image data for screen printing 48 is obtained in step 4. In step 5, a screen plate 60 for screen printing is manufactured on the basis of the image data for screen printing 48. Incidentally, these steps, step 1 to step 5 are not necessarily performed each time printing is carried out. In other words, the respective image data 40, 47, 48 in step 1 to step 4 are stored and the screen plate 60 from step 5 is used many times.

Figure 3:
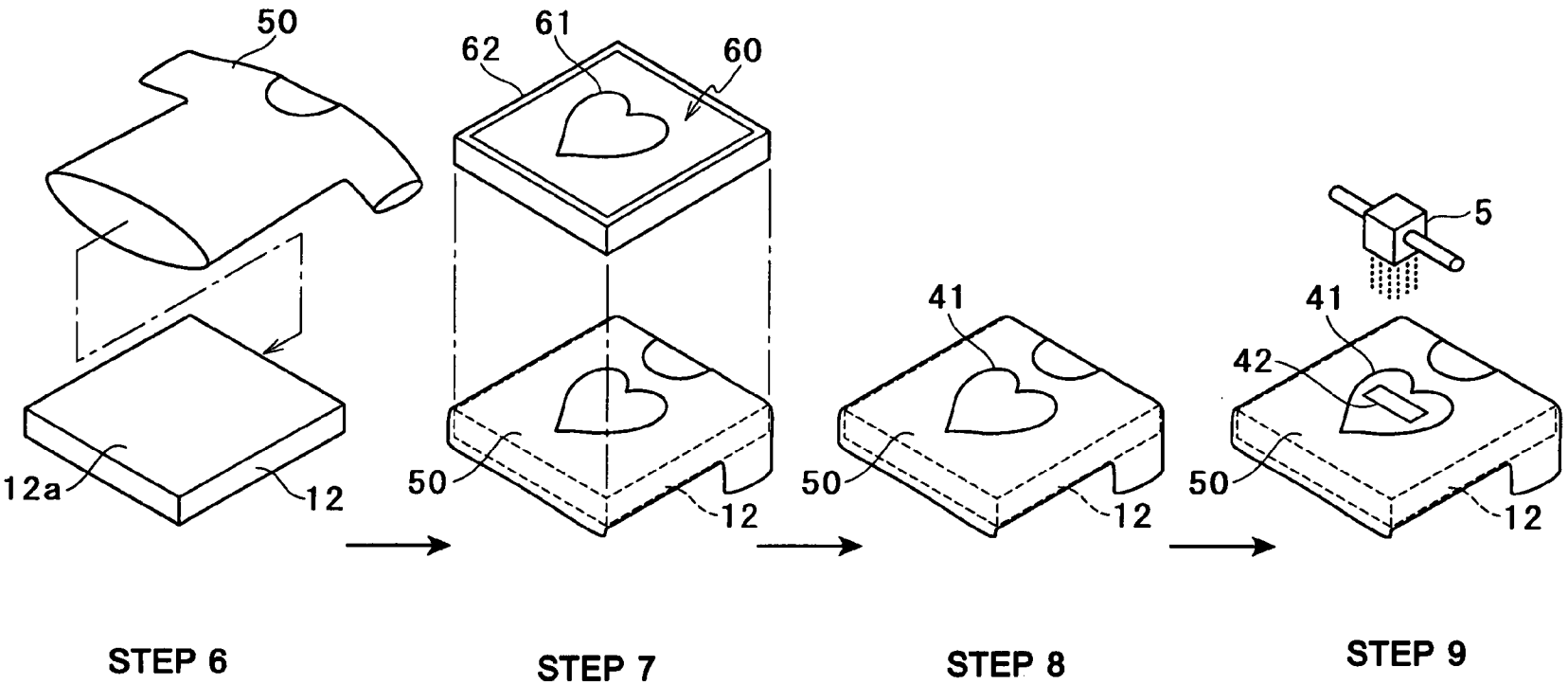
FIG. 3 is a process diagram giving a schematic illustration of the printing process according to the present embodiment, from the step of setting a fabric on a platen to the end of printing.

Thereupon, as illustrated in FIG. 3, at step 6, the fabric (T-shirt) 50 is installed on the platen 12 of the ink-jet printer 1, and in step 7, the screen plate 60 manufactured in step 5 is fitted onto the platen 12 and screen printing is performed onto the fabric 50. In step 8, the screen plate 60 is removed from the platen 12, and in step 9, ink-jet printing is performed onto the fabric 50 by means of the ink-jet heads 5. These steps, step 6 to step 9, are performed in this sequence once each time a piece of fabric 50 is printed.

In FIG. 2, step 1 to step 4 are carried out by image processing functions of a personal computer, or the like, which forms a portion of the printing system, but these functions may also be incorporated into the ink-jet printer 1. The original image data 40 in step 1 may be data obtained from any type of original image, such as a photograph, illustration, or the like. In this example, the original image data 40 consists of a monochromatic background image 41 in the shape of a heart, and a high-density full color image 42 based on a photograph. The region 43 illustrated by the dotted lines is the printable region which is displayed on a display screen together with the original image data 40, and this region corresponds to the platen 12 of the ink-jet printer 1.

Next, the original image data 40 is divided up by means of image processing in step 2. In other words, the high-density full-color image 42 is assigned for ink-jet printing and the background image 41 is assigned for screen printing. At the same time, the color of the ink for the background image 41 is decided. In other words, if the fabric is a dark color, then if an image is printed by emitting ink directly onto the dark-colored fabric by means of the ink-jet heads 5 of the ink-jet printer 1, then the color of the ink forming the image will be obscured (darkened) by the dark-colored fabric, and hence the desired ink colors will not be obtained.

Figure 4:
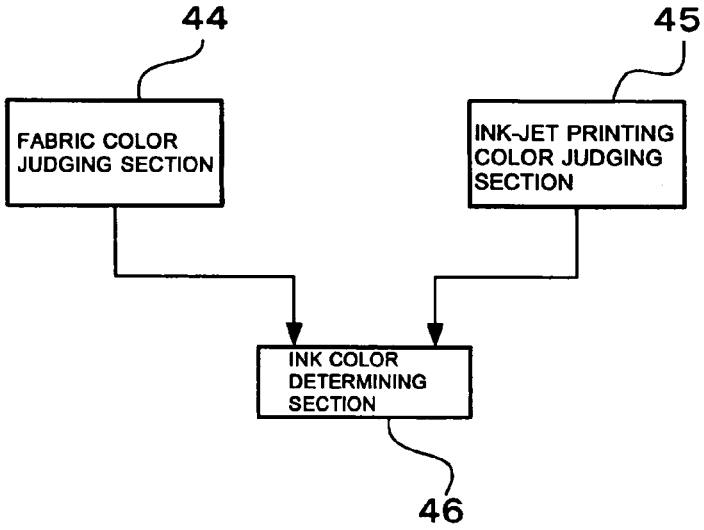
FIG. 4 is a block diagram showing the configuration of ink determining means.

FIG. 4 is a block diagram showing the configuration of ink color determining means, and in the present embodiment, the ink color determining means is incorporated into the image processing functions of the personal computer, or the like. The ink color determining means comprises a fabric color judging section 44 to which the color of the fabric is input, an ink-jet printing color judging section 45 to which the ink color of the ink-jet printing is input, and an ink color determining section 46 for determining the color of the ink for screen printing, on the basis of the judgments made by the judging sections 44, 45. In the present embodiment, an image is printed onto a black fabric, and a light colored ink, and in particular, a white ink, is selected by the ink color determining means, for the background image 41.

By this means, the image data for ink-jet printing 47 in step 3 and the image data for screen printing 48 in step 4 are obtained. The image data for ink-jet printing 47 coincides with the high-density full-color image 42. The image data for screen printing 48 coincides with the background image 41, but in order that the aforementioned white colored ink is provided underneath the color image 42, it also incorporates a portion in which the color image 42 is extracted. The region 43 indicated by the dotted lines shows the same printable region as in step 1.

Next, in step 5, a screen plate 60 for screen printing is manufactured on the basis of the image data for screen printing 48. This screen plate 60 is manufactured by a separate screen plate manufacturing device (not illustrated). A commonly known method may be used to manufacture the screen plate, and in general, a method such as the following is used. Namely, a screen mesh is stretched over a frame, and a photosensitive emulsion is coated thereon and left to cure. On the other hand, a design is traced onto an transparent film, this film is brought into contact with the frame coated with photosensitive emulsion, and is then exposed by means of a chemical lamp. After exposure, the frame is immersed in water, and the photosensitive portion remains, whilst the non-photosensitive portion is removed, thereby yielding a screen plate.

The image forming section 61 of the screen plate 60 is created by using a mask, and this mask is fabricated on the basis of the image data for screen printing 48. After exposure, only the portion of the screen plate 60 that was masked remains, thereby yielding the image forming section 61 of the screen plate 60. Here, in particular, the screen plate 60 is manufactured to the same size as the upper face 12*a* of the platen 12. Since the region 43 in Step 4 corresponds to the platen 12, the image data for screen printing 48 inside that region 43 also corresponds to the platen 12 and is formed as an image forming section 61 on the screen plate 60.

Next, as shown in FIG. 3, in step 6, the fabric (T-shirt) 50 is installed on the platen 12 in such a manner that the surface thereof to be printed, such as the chest region or back region, is positioned on the upper face 12*a* of the platen 12. In other words, the fabric 50 forming a tubular or bag shape is placed over the platen 12, in such a manner that the platen 12 enters inside the opening of the fabric 50 (for instance, the hem opening of the T-shirt).

Thereupon, in step 7, the screen plate 60 manufactured in step 5 is fitted onto the platen 12. Details of the fitting structure are described below, but essentially, the screen plate 60 comprises a frame 62. The screen plate 60 is designed such that together with the frame 62, it forms a lid shape which covers the upper face 12*a* of the platen 12. The screen plate 60 fits onto the platen 12 in such a manner that the fabric 50 is sandwiched between the screen plate 60 and the platen 12. Thereupon, the operator performs screen printing by coating white ink onto the image forming section 61 of the screen plate 60.

When screen printing has been completed, in step 8, the screen plate 60 is removed from the platen 12. An image which is the same as the image forming section 61, in other words, a background image 41 as specified in Step 1, has been printed on the fabric 50 in white ink.

Next, in step 9, a printing start command is issued to the ink-jet printer 1, and as illustrated in FIG. 1, ink-jet printing is performed onto the fabric 50 by means of the ink-jet heads 5. This printing is carried out on the basis of the image data for ink-jet printing 47 obtained in step 3, and on the basis of the platen 12 which corresponds to the region 43. As a result, a high-density full-color image 42 as specified in step 1 is printed onto the white background image 41 on the fabric 50.

As described above, when printing has been completed, the white background image 41 screen printed onto the fabric 50 and the color image 42 printed by ink-jet printing will be superimposed accurately on each other and match the original image. The reason for this is that the screen plate 60 and the upper face 12*a* of the platen 12 are of the same size, and the image forming section 61 on the screen plate 60 is formed in the same position as the color image 42 printed by ink-jet printing, on the basis of the platen 12. Furthermore, the image forming section 61 on the screen plate 60 is formed on the basis of image data for screen printing 48 that is extracted from the same original image data 40 that contains the color image 42.

As described above, according to the printing device of the present embodiment, by providing a screen plate 60 which fits detachably onto the upper face 12*a* of the platen 12 on which the fabric is set 50, the printing device can be reduced in size, as compared with a device in which a plurality of screen plates are arranged in a parallel fashion in the direction of travel of a conveyor belt. Moreover, since the screen plate 60 and the upper face 12*a* of the platen 12 are of the same shape, it is possible to ensure that the background image 41 and color image 42 printed onto the fabric 50 are superimposed accurately, without any positional divergence, simply by aligning the size and position of the background image 41 formed by screen printing and the color image 42 formed by ink-jet printing, on the basis of the upper face 12*a* of the platen 12. Therefore, it is possible to devise a printing device which does not require means for controlling the positional alignment of the images 41, 42 created by two different printing methods, and hence it is possible to simplify the configuration and functions of the printing device. Moreover, special positional alignment tasks are not required, it being sufficient simply to fit the screen plate 60 onto the upper face 12*a* of the platen 12, and therefore the workability and device operability can be improved.

Moreover, according to the printing device and printing system of the present embodiment, by providing ink color determining means, it is possible to ensure that the ink used in the screen printing step is lighter than the ink used in the ink-jet printing step (and preferably it is white). Consequently, when printing of the color image 42 has been completed by ink-jet printing on top of the background image 41 formed by screen printing, the color image 42 will not be obscured, but rather a clear color image 42 will be obtained. In other words, in cases where a color image 42 is printed by printing ink directly onto a dark-colored fabric 50 by means of the ink-jet heads 5, the colors of the ink forming the color image 42 will be obscured by the dark-colored fabric 50, but since the light-colored (white) background image 41 printed in the screen printing step is not obscured by the dark-colored fabric 50, then by printing a color image 42 over this background image 41, by ink-jet printing, the obscuring of the colors of the color image 42 is restricted. Therefore, the inks of the color image 42 ultimately formed on the fabric 50 show good coloration, and hence the reproducibility of the inks is improved, in addition to which the color image 42 can be depicted in a clear fashion.

In the present embodiment, a case was described in which the worker installs and removes a screen plate 60 to and from the platen 12, but it is also possible to provide a lifting mechanism for the screen plate 60, and to provide control means for performing control whereby, after screen printing, the platen 12 is moved to the ink-jet printing position in order that ink-jet printing can be performed, in coordination with the lifting of the screen plate 60. If a configuration of this kind is adopted, then a fabric 50 having the desired image printed thereon can be obtained automatically, simply by means of the operator setting the fabric 50 on the platen 12, and hence the manufacturing tasks involved in printing the image onto the fabric 50 can be reduced.

(Fitting Structure of the Screen Plate)

Figure 5:
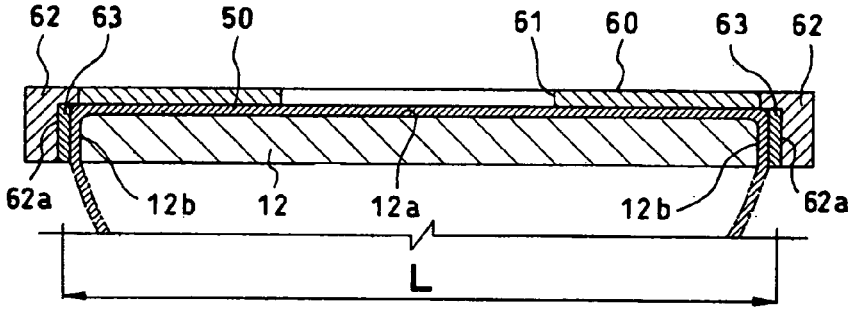
FIG. 5 is a cross-sectional view showing a screen plate according to the present embodiment, in a fitted state.

Next, the fitting structure whereby the screen plate 60 can be installed on the platen 12 and removed from same will be described. FIG. 5 is a cross-sectional diagram of the screen plate according to the present embodiment in a fitted state.

The screen plate 60 shown in FIG. 5 has the most basic structure. As described above, the screen plate 60 comprises a frame 62, and the screen plate 60 and the frame 62 together form an upper lid shape which covers the upper face 12*a* of the platen 12. When the screen plate 60 is installed from above on the platen 12, in such a manner that the fabric 50 is sandwiched between the screen plate 60 and the upper face 12*a* of the platen 12, the inner circumferential face 62*a* of the frame 62 contacts tightly with the outer circumferential face 12*b* of the platen 12, with the fabric 50 being sandwiched therebetween. In this way, the screen plate 60 formed to the same size as the upper face 12*a* of the platen 12 is fitted in substantially the same position on the upper face 12*a* of the platen 12. Elastic members 63 such as rubber sheets, or the like, are provided along all four sides of the inner circumferential face 62*a* of the frame 62. These elastic members 63 serve to prevent the fabric 50 from being damaged, as well as to increase the tightness of fitting.

The screen plate 60 is formed to the same size as the upper face 12*a* of the platen 12, and positioning of the screen plate 60 with respect to the upper face 12*a* of the platen 12 affects the degree to which the two images formed by the subsequent printing steps are accurately superimposed. However, the thickness of the fabric 50 may vary, according to the material used, the way in which it is woven, or the like, and if the thickness of the fabric 50 varies in this way, then the screen plate 60 is liable to become loose. Moreover, this looseness cannot readily be absorbed by the elastic members 63 alone.

Therefore, it is also possible to prepare a plurality of screen plates of different sizes according to different thicknesses of fabric 50, in such a manner that the screen plate 60 can be fitted onto the upper face 12*a* of the platen 12 without forming a substantial gap between itself and the fabric 50. Although not illustrated, screen plates of various types may be formed by adopting various sizes of frame 62, in such a manner that the distance L between the inner circumferential faces 62*a* of the two opposing sides of the frame 62, as illustrated by the screen plate 60 in FIG. 5, (or the length between the two other opposite sides), varies.

Figure 6:
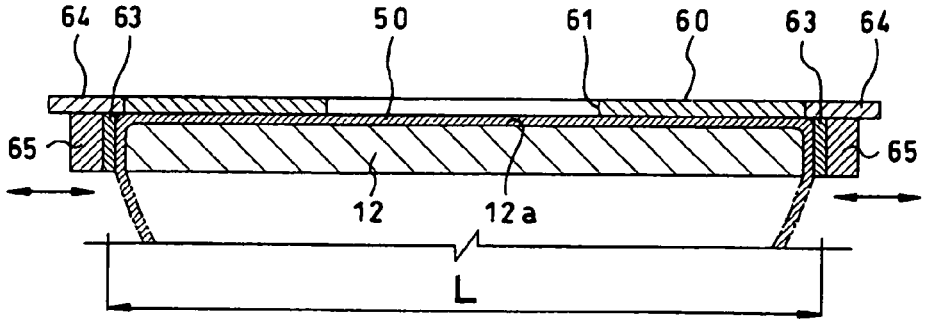
FIG. 6 is a cross-sectional view showing a screen plate according to a modification, in a fitted state.
Figure 7A:
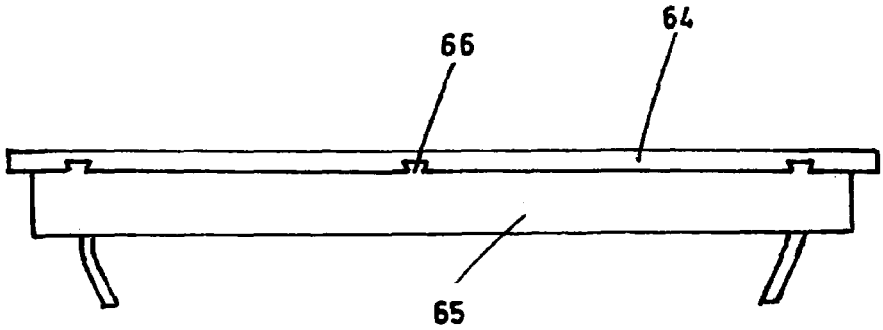
FIG. 7A is a representation of a modification showing an interlocking groove allowing adjustability of the screen plate.
Figure 7B:
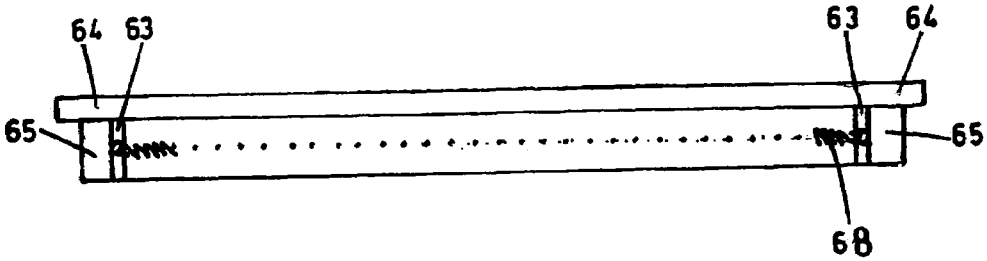
FIG. 7B is a view of a spring adjusting mechanism of the modification.

Moreover, FIG. 6 shows a cross-sectional view of a screen plate according to a modification example, in a fitted state. In this modification, the frame of the screen plate 60 is constituted by first frame member 64 and second frame members 65. The pair of second frame members 65 which form two opposing sides (the same may apply to the other two opposing sides) are formed slidably on the lower faces of the first member 64 in such a manner that the distance L increases or decreases. This sliding action may be achieved by means of interlocking grooves 66 (FIG. 7A), or the like, on the contact faces of the respective frame members 64, 65, for example, a sliding force being applied by means of a spring 68 (FIG. 7B), or the like, in such a manner that the distance L contracts.

If an adjusting mechanism for fitting the screen plate 60 onto the platen 12 is provided in this way, then there will be substantially no gaps between the screen plate 60 and the fabric 50, and hence it will be possible to prevent the fabric 50 from forming wrinkles or lifting between the upper face 12*a* of the platen and the screen plate 60, thereby ensuring that an image of good quality can be printed on the fabric 50. Moreover, by this means, it becomes unnecessary to prepare a plurality of different screen plates, and hence costs can be lowered.

If the fabric set on the platen is smaller than the upper face of the platen, then it is possible to align the positions of the screen plate and the upper face of the platen, by abutting the inner circumferential faces of two adjacent sides of the frame of the screen plate and the outer circumferential faces of the two sides of the platen corresponding to these. Moreover, one side of the frame of the screen plate may be supported rotatably about the platen, and the screen plate and the upper face of the platen can be aligned in position by taking this side as a reference.

As above, an embodiment of the present invention was described, but the present invention is not limited to the aforementioned embodiment and various design modifications are possible provided that they remain within the scope of the claims. For example, the printing medium on which the two types of images are printed does not have to be a tubular or bag-shaped fabric, such as a T-shirt, as described in the embodiment, and it may be a single sheet of fabric, such as a handkerchief, of any size. Moreover, the present invention is not limited to cloth fabrics, and may also be applied to wooden boards, plastic sheeting, or the like.

As described above, according to the printing device described in a first aspect of the invention, by providing a screen plate that fits detachably with the supporting face of a printing medium support member on which the print medium is supported, it is possible to reduce the size of the printing device, as compared with a device in which a plurality of screen plates are provided in parallel fashion in the direction of travel of a conveyor belt. Moreover, if the image printed on the printing medium by means of a screen plate is the same size as the image printed on the printing medium by emission of ink from an ink emission section, then since the screen plate fits detachably to the supporting face of the printing medium supporting member, the images printed onto the printing medium can be mutually superimposed accurately, simply by means of aligning the positions of the image formed by the screen plate and the image formed by the ink emission section, by taking the supporting face as a reference. Therefore, it is not necessary to provide the printing device with control means, or the like, for aligning the position of images created by two different printing methods, and hence the configuration and functions of the printing device can be simplified. Since no special positional alignment tasks are required, it being sufficient simply to fit the screen plate onto the supporting face of the printing medium supporting member, then it is possible to improve the workability and the operability of the device.

In the printing device of the present invention, preferably, by comprising ink color determining means, the ink used in printing by means of the screen plate can be set to a color that is lighter than the ink used in printing by means of the ink emission section. Consequently, when an image has been printed by means of the ink emission section onto an image printed onto the printing medium by means of the screen plate, the inks in the final image on the printing medium will show good coloration, the reproducibility of the inks will be improved, and furthermore it will be possible to depict the image in a clear fashion.

In the printing device of the present invention, preferably, by setting the ink used in the printing by means of the screen plate to white ink, when an image has been printed by means of the ink emission section onto an image printed on the printing medium by means of the screen plate, then the inks in the final image on the printing medium will display even better coloration, the reproducibility of the inks will be improved, and furthermore it will be possible to depict the image in an even clearer fashion.

In the print device of the present invention, preferably, by preparing a plurality of different types of screen plates each having different sizes according to the thickness of the printing medium supported on the printing medium supporting member, there will be substantially no gaps between the screen plate and the printing medium, and hence the printing medium can be prevented from rising up between the supporting face and the screen plate, or forming wrinkles, thus ensuring that a good quality image can be printed onto the printing medium.

In the printing device of the present invention, preferably, by providing an adjustment mechanism in the screen plate or printing medium supporting member, it becomes unnecessary to prepare a plurality of different types of screen plates, and hence costs can be reduced.

In the printing device of the present invention, since the screen plate and the supporting face are preferably of the same shape, then simply by aligning the size and position of the image formed by means of the screen plate and the image formed by means of the ink emission section, by taking the supporting face as a reference, the images formed by the respective printing methods on the printing medium are superimposed accurately without positional deviation therebetween. Therefore, it is not necessary to provide the printing device with control means, or the like, for aligning the positions of the images created by two different printing methods, and hence the configuration and functions of the printing device can be simplified. Since no special positional alignment tasks are required, then it is possible to improve the workability and the operability of the device.

In the printing device of the present invention, even if a dark-colored fabric is used as the printing medium, since printing by means of the ink emission section is preferably carried out on top of an image printed by means of the screen plate, it is possible to print an image of good quality onto the fabric.

In the printing device of the invention, preferably, by providing ink color determining means, it is possible to set the ink used in printing by means of the screen plate to a color that is lighter than the ink used in printing by means of the ink emission section. Therefore, when an image has been printed by means of the ink emission section onto an image printed on the printing medium by means of the screen plate, the inks in the final image on the printing medium will display good coloration, the reproducibility of the inks will be increased, and furthermore, it will be possible to depict the image in a clear fashion.

According to the printing system described in the second aspect of the present invention, since the ink used in the printing by means of the screen plate is set to white ink, then when an image has been printed by means of the ink emission section onto an image printed on the printing medium by means of the screen plate, the inks in the final image on the printing medium will display good coloration, the reproducibility of the inks will be increased, and furthermore, it will be possible to depict the image in a clear fashion.

According to the printing method described in the third aspect of the present invention, when an image has been printed by means of the ink emission section in the ink emitting step, onto an image printed onto a printing medium in a screen printing step, the colors of the image in the printing carried out by the ink emission step will not be obscured, and it will be possible to obtain a clear image. Therefore, the inks in the final image on the printing medium will display good coloration, the reproducibility of the inks will be increased, and furthermore, it will be possible to depict the image in a clear fashion.

In the printing method of the present invention, since the ink used in the screen printing step is preferably set to be white ink, then when an image has been printed by means of the ink emission section in the ink emission step, onto an image printed on the printing medium in the screen printing step, the inks in the final image on the printing medium will display even better coloration and the reproducibility of the inks will be increased, and furthermore, it will be possible to depict the image in an even clearer fashion.

The entire disclosure of the specification, claims, summary and drawings of Japanese Patent Application No. 2003-89011 filed on Mar. 27, 2003 is hereby incorporated by reference.

What is claimed is:

1. A printing device, comprising:

a platen having a supporting face for supporting fabric as a printing medium, the platen moving in an intended direction;

a screen plate used during screen printing fitting detachably onto said supporting face in a state where the printing medium is sandwiched between said screen plate and said supporting face of said platen; and an ink-jet head for performing ink-jet printing onto said printing medium that has been subjected to screen-printing using said screen plate, in a state where said printing medium is supported on said supporting face of said platen, wherein said screen plate comprises a first frame member and at least a pair of second frame members, said frame members of said at least one pair of second frame members opposing one another and slidably engaged with an underside of said first frame member by interlocking grooves.

2. The printing device according to claim 1, further comprising ink color determining means for setting the color of the ink used in printing using said screen plate to a lighter color than the ink used in printing by said ink-jet head.

3. The printing device according to claim 2, wherein said ink color determining means set the color of the ink used in printing using said screen plate to white.

4. The printing device according to claim 1, wherein a plurality of said screen plates of different types are prepared, each having a different size in accordance with the thickness of the printing medium, in such a manner that said screen plate fits onto said supporting face in a state with substantially no gaps with respect to the printing medium.

5. The printing device according to claim 1, wherein said screen plate or said platen comprises an adjusting mechanism whereby said screen plate can be fitted onto said supporting face in a state with substantially no gaps with respect to the printing medium.

6. The printing device according to claim 1, wherein said screen plate is of substantially the same shape as said supporting face.

7. The printing device according to claim 1, wherein the printing medium is a fabric.

8. A printing system comprising:

the printing device according to claim 1; and ink color determining means for setting the color of the ink used in printing by said screen plate to a lighter color than the ink used in printing by said ink-jet head.

9. The printing system according to claim 8, wherein said ink color determining means sets the color of the ink used in printing using said screen plate to white.

10. A printing method, comprising mounting a printing medium onto a platen having a supporting face for supporting fabric as a printing medium, the platen moving in an intended direction;

placing a screen plate over the printing medium;

screen printing onto the printing medium using the screen plate; and ink-jet printing by emitting ink of a darker color than the ink used in said screen printing step, onto the screen printed region, from an ink-jet head with the printing medium on the platen, wherein said screen elate comprises a first frame member and at least a pair of second frame members, said frame members of said at least one pair of second frame members opposing one another and slidably engaged with an underside of said first frame member by interlocking grooves.

11. The printing method according to claim 10, wherein the ink used in said screen printing step is white in color.

12. A printing device, comprising:

a platen having a supporting face for supporting fabric as a printing medium, the platen moving in an intended direction;

a screen plate used during screen printing fitting said supporting face in a state where the printing medium is sandwiched between said screen plate and said supporting face of said platen;

an ink-jet head for performing ink-jet printing onto said printing medium, that has been subjected to screen-printing using said screen plate, in a state where said printing medium is supported on said supporting face of said platen, and a frame, wherein the screen plate together with the frame have a lock-and-key relationship with the platen, wherein said screen plate comprises a first frame member and at least a pair of second frame members, said frame members of said at least one pair of second frame members opposing one another and slidably engaged with an underside of said first frame member by interlocking grooves.

13. The printing device according to claim 12, wherein at least one of the screen plate and the frame includes at least one of a projection and a groove, and the platen includes the other of the projection and the groove such that when the screen plate and the frame are detachably connected to the platen the at least one projection connects with the at least one groove to lock the screen plate in position relative to the platen.

14. The printing device according to claim 13, wherein the screen plate is integrally connected to the frame.

15. The printing device according to claim 13, wherein the screen plate is detachably attached to the frame.

* * * * *